US009321965B2

(12) United States Patent
Barkdoll

(10) Patent No.: US 9,321,965 B2
(45) **Date of Patent: *Apr. 26, 2016**

(54) FLAT PUSH COKE WET QUENCHING APPARATUS AND PROCESS

(75) Inventor: Michael P. Barkdoll, Knoxville (TN)

(73) Assignee: SunCoke Technology and Development LLC., Lisle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/205,960

(22) Filed: Aug. 9, 2011

(65) Prior Publication Data

US 2012/0024688 A1 Feb. 2, 2012

Related U.S. Application Data

(63) Continuation of application No. 12/405,269, filed on Mar. 17, 2009, now Pat. No. 7,998,316.

(51) Int. Cl.
*C10B 39/04* (2006.01)
*C10B 39/14* (2006.01)

(52) U.S. Cl.
CPC ..... *C10B 39/14* (2013.01); *C10B 39/04* (2013.01)

(58) Field of Classification Search
CPC ..... C10B 49/04; C10B 49/14
USPC ..... 201/39; 202/227, 262, 263
See application file for complete search history.

(56) References Cited

U.S. PATENT DOCUMENTS

| | | | |
|---|---|---|---|
| 469,868 | A | 3/1892 | Thomas et al. |
| 1,140,798 | A | 5/1915 | Carpenter |
| 1,424,777 | A | 8/1922 | Schondeling |
| 1,430,027 | A | 9/1922 | Plantinga |
| 1,486,401 | A | 3/1924 | Van Ackeren |
| 1,572,391 | A | 2/1926 | Klaiber |

(Continued)

FOREIGN PATENT DOCUMENTS

| | | | |
|---|---|---|---|
| CA | 2775992 | A1 | 5/2011 |
| CA | 2822857 | A1 | 7/2012 |

(Continued)

OTHER PUBLICATIONS

JP 03-197588, Inoqu Keizo et al., Method and Equipment for Boring Degassing Hole in Coal Charge in Coke Oven, Japanese Patent (Abstract Only) Aug. 28, 1991.

(Continued)

*Primary Examiner* — Jill Warden
*Assistant Examiner* — Joye L Woodard
(74) *Attorney, Agent, or Firm* — Perkins Coie LLP

(57) ABSTRACT

A method and apparatus for quenching metallurgical coke made in a coking oven. The method includes pushing a unitary slab of incandescent coke onto a substantially planar receiving surface of an enclosed quenching car so that substantially all of the coke from the coking oven is pushed as a unitary slab onto the receiving surface of the quenching car. The slab of incandescent coke is quenched in an enclosed environment within the quenching car with a plurality of water quench nozzles while submerging at least a portion of the slab of incandescent coke by raising a water level in the quenching car. Subsequent to quenching the coke, the planar receiving surface is tilted to an angle sufficient to slide the quenched coke off of the planar receiving surface and onto a product collection conveyer and sufficient to drain water from the quenched coke.

20 Claims, 11 Drawing Sheets

(56) References Cited

U.S. PATENT DOCUMENTS 1,721,813 A 7/1929 Rudolf et al.
1,818,370 A 8/1931 Wine
1,818,994 A 8/1931 Kreisinger
1,848,818 A 3/1932 Becker
1,955,962 A 4/1934 Jones
2,075,337 A 3/1937 Bumaugh
2,394,173 A 2/1946 Harris et al.
2,424,012 A 7/1947 Bangham et al.
2,667,185 A 1/1954 Beavers
2,723,725 A 11/1955 Keiffer
2,756,842 A 7/1956 Chamberlin et al.
2,873,816 A 2/1959 Emil et al.
2,902,991 A 9/1959 Whitman
3,033,764 A 5/1962 Hannes
3,511,030 A 5/1970 Brown et al.
3,545,470 A 12/1970 Paton
3,616,408 A 10/1971 Hickam
3,630,852 A 12/1971 Nashan et al.
3,652,403 A * 3/1972 Knappstein et al. ..... 201/39
3,676,305 A 7/1972 Cremer
3,709,794 A 1/1973 Kinzler et al.
3,710,551 A 1/1973 Sved
3,746,626 A 7/1973 Morrison, Jr.
3,748,235 A 7/1973 Pries
3,784,034 A 1/1974 Thompson
3,806,032 A 4/1974 Pries
3,836,161 A 9/1974 Buhl
3,839,156 A 10/1974 Jakobi et al.
3,844,900 A 10/1974 Schulte
3,857,758 A 12/1974 Mole
3,875,016 A 4/1975 Schmidt-Balve et al.
3,876,506 A 4/1975 Dix et al.
3,878,053 A 4/1975 Hyde
3,894,302 A 7/1975 Lasater
3,897,312 A 7/1975 Armour et al.
3,906,992 A 9/1975 Leach
3,912,091 A 10/1975 Thompson
3,917,458 A 11/1975 Polak
3,930,961 A 1/1976 Sustarsic et al.
3,957,591 A 5/1976 Riecker
3,959,084 A 5/1976 Price
3,963,582 A 6/1976 Helm et al.
3,969,191 A 7/1976 Bollenbach et al.
3,975,148 A 8/1976 Fukuda et al.
3,984,289 A 10/1976 Sustarsic et al.
4,004,702 A 1/1977 Szendroi
4,004,983 A 1/1977 Pries
4,040,910 A 8/1977 Knappstein et al.
4,059,885 A 11/1977 Oldengott
4,067,462 A 1/1978 Thompson
4,083,753 A 4/1978 Rogers et al.
4,086,231 A 4/1978 Ikio
4,100,033 A 7/1978 Holter
4,111,757 A 9/1978 Ciarimboli
4,124,450 A 11/1978 MacDonald
4,141,796 A 2/1979 Clark et al.
4,145,195 A 3/1979 Knappstein et al.
4,147,230 A 4/1979 Ormond et al.
4,162,546 A 7/1979 Shortell et al.
4,189,272 A 2/1980 Gregor et al.
4,194,951 A 3/1980 Pries
4,196,053 A 4/1980 Grohmann
4,211,608 A 7/1980 Kwasnoski et al.
4,211,611 A 7/1980 Bocsanczy et al.
4,213,489 A 7/1980 Cain
4,213,828 A 7/1980 Calderon
4,222,748 A 9/1980 Argo et al.
4,222,824 A 9/1980 Flockenhaus et al.
4,224,109 A 9/1980 Flockenhaus et al.
4,225,393 A 9/1980 Gregor et al.
4,235,830 A 11/1980 Bennett et al.
4,248,671 A 2/1981 Belding
4,249,997 A 2/1981 Schmitz
4,263,099 A 4/1981 Porter
4,285,772 A 8/1981 Kress
4,287,024 A 9/1981 Thompson
4,289,584 A 9/1981 Chuss et al.
4,289,585 A 9/1981 Wagener et al.
4,303,615 A 12/1981 Jarmell et al.
4,307,673 A 12/1981 Caughey
4,314,787 A 2/1982 Kwasnik et al.
4,330,372 A 5/1982 Cairns et al.
4,334,963 A 6/1982 Stog
4,336,843 A 6/1982 Petty
4,340,445 A 7/1982 Kucher et al.
4,344,820 A 8/1982 Thompson
4,366,029 A 12/1982 Bixby et al.
4,373,244 A 2/1983 Mertens et al.
4,375,388 A 3/1983 Hara et al.
4,391,674 A 7/1983 Velmin et al.
4,392,824 A 7/1983 Struck et al.
4,395,269 A 7/1983 Schuler
4,396,394 A 8/1983 Li et al.
4,396,461 A 8/1983 Neubaum et al.
4,431,484 A 2/1984 Weber et al.
4,439,277 A 3/1984 Dix
4,440,098 A 4/1984 Adams
4,445,977 A 5/1984 Husher
4,446,018 A 5/1984 Cerwick
4,448,541 A 5/1984 Wirtschafter
4,452,749 A 6/1984 Kolvek et al.
4,459,103 A 7/1984 Gieskieng
4,469,446 A 9/1984 Goodboy
4,498,786 A 2/1985 Ruscheweyh
4,508,539 A 4/1985 Nakai
4,527,488 A 7/1985 Lindgren
4,568,426 A 2/1986 Orlando et al.
4,570,670 A 2/1986 Johnson
4,614,567 A 9/1986 Stahlherm et al.
4,645,513 A 2/1987 Kubota et al.
4,655,193 A 4/1987 Blacket
4,655,804 A 4/1987 Kercheval et al.
4,666,675 A 5/1987 Parker et al.
4,680,167 A 7/1987 Orlando et al.
4,704,195 A 11/1987 Janicka et al.
4,726,465 A 2/1988 Kwasnik et al.
4,824,614 A 4/1989 Jones et al.
4,919,170 A 4/1990 Kallinich et al.
4,929,179 A 5/1990 Breidenbach et al.
4,941,824 A 7/1990 Holter et al.
5,052,922 A 10/1991 Stokman et al.
5,062,925 A 11/1991 Durselen et al.
5,078,822 A 1/1992 Hodges et al.
5,114,542 A 5/1992 Childress et al.
5,227,106 A 7/1993 Kolvek
5,228,955 A 7/1993 Westbrook, III
5,318,671 A 6/1994 Pruitt
5,447,606 A 9/1995 Prutt et al.
5,480,594 A 1/1996 Wilkerson et al.
5,670,025 A 9/1997 Baird
5,687,768 A 11/1997 Albrecht et al.
5,787,821 A 8/1998 Bhat et al.
5,810,032 A 9/1998 Hong et al.
5,928,476 A 7/1999 Daniels
5,968,320 A 10/1999 Sprague
6,017,214 A 1/2000 Sturgulewski
6,059,932 A 5/2000 Sturgulewski
6,139,692 A 10/2000 Tamura et al.
6,152,668 A 11/2000 Knoch
6,187,148 B1 2/2001 Sturgulewski
6,290,494 B1 9/2001 Barkdoll
6,596,128 B2 7/2003 Westbrook
6,626,984 B1 9/2003 Taylor
6,699,035 B2 3/2004 Brooker
6,758,875 B2 7/2004 Reid et al.
6,907,895 B2 6/2005 Johnson et al.
6,946,011 B2 9/2005 Snyder
7,077,892 B2 7/2006 Lee
7,314,060 B2 1/2008 Chen et al.
7,331,298 B2 2/2008 Taylor et al.
7,497,930 B2 3/2009 Barkdoll et al.
7,611,609 B1 11/2009 Valia et al.
7,644,711 B2 1/2010 Creel
7,803,627 B2 9/2010 Hodges

(56) References Cited

U.S. PATENT DOCUMENTS

| | | | |
|---|---|---|---|
| 7,827,689 | B2 | 11/2010 | Crane et al. |
| 7,998,316 | B2 | 8/2011 | Barkdoll et al. |
| 8,079,751 | B2 | 12/2011 | Kapila et al. |
| 8,152,970 | B2 | 4/2012 | Barkdoll et al. |
| 8,236,142 | B2 | 8/2012 | Westbrook et al. |
| 8,266,853 | B2 | 9/2012 | Bloom et al. |
| 8,398,935 | B2 | 3/2013 | Howell, Jr. et al. |
| 2002/0170605 | A1 | 11/2002 | Shiraishi et al. |
| 2003/0014954 | A1 | 1/2003 | Ronning et al. |
| 2003/0015809 | A1 | 1/2003 | Carson |
| 2006/0102420 | A1 | 5/2006 | Huber et al. |
| 2007/0116619 | A1 | 5/2007 | Taylor et al. |
| 2007/0205091 | A1 | 9/2007 | Barkdoll et al. |
| 2007/0251198 | A1 | 11/2007 | Witter |
| 2008/0028935 | A1 | 2/2008 | Andersson |
| 2008/0169578 | A1 | 7/2008 | Crane et al. |
| 2008/0179165 | A1 | 7/2008 | Chen et al. |
| 2008/0257236 | A1 | 10/2008 | Green |
| 2008/0271985 | A1 | 11/2008 | Yamasaki |
| 2008/0289305 | A1 | 11/2008 | Girondi |
| 2009/0152092 | A1 | 6/2009 | Kim et al. |
| 2009/0217576 | A1 | 9/2009 | Kim et al. |
| 2009/0283395 | A1 | 11/2009 | Hippe |
| 2010/0095521 | A1 | 4/2010 | Bertini et al. |
| 2010/0115912 | A1 | 5/2010 | Worley et al. |
| 2010/0287871 | A1 | 11/2010 | Bloom et al. |
| 2010/0300867 | A1 | 12/2010 | Kim et al. |
| 2011/0048917 | A1 | 3/2011 | Kim et al. |
| 2011/0120852 | A1 | 5/2011 | Kim et al. |
| 2011/0174301 | A1 | 7/2011 | Haydock et al. |
| 2011/0192395 | A1 | 8/2011 | Kim et al. |
| 2011/0253521 | A1 | 10/2011 | Kim |
| 2011/0315538 | A1 | 12/2011 | Kim et al. |
| 2012/0024688 | A1 | 2/2012 | Barkdoll |
| 2012/0030998 | A1 | 2/2012 | Barkdoll et al. |
| 2012/0152720 | A1 | 6/2012 | Reichelt et al. |
| 2012/0228115 | A1 | 9/2012 | Westbrook |
| 2012/0305380 | A1 | 12/2012 | Wang et al. |
| 2013/0216717 | A1 | 8/2013 | Rago et al. |
| 2013/0306462 | A1 | 11/2013 | Kim et al. |
| 2014/0033917 | A1 | 2/2014 | Rodgers et al. |
| 2014/0048402 | A1 | 2/2014 | Quanci et al. |
| 2014/0048404 | A1 | 2/2014 | Quanci et al. |
| 2014/0048405 | A1 | 2/2014 | Quanci et al. |
| 2014/0061018 | A1 | 3/2014 | Sarpen et al. |
| 2014/0083836 | A1 | 3/2014 | Quanci et al. |
| 2014/0182195 | A1 | 7/2014 | Quanci et al. |
| 2014/0182683 | A1 | 7/2014 | Quanci et al. |
| 2014/0183023 | A1 | 7/2014 | Quanci et al. |
| 2014/0183024 | A1 | 7/2014 | Chun et al. |
| 2014/0183026 | A1 | 7/2014 | Quanci et al. |
| 2014/0224123 | A1 | 8/2014 | Walters |
| 2014/0262139 | A1 | 9/2014 | Choi et al. |
| 2014/0262726 | A1 | 9/2014 | West et al. |
| 2015/0122629 | A1 | 5/2015 | Freimuth et al. |
| 2015/0247092 | A1 | 9/2015 | Quanci et al. |
| 2015/0287026 | A1 | 10/2015 | Yang et al. |

FOREIGN PATENT DOCUMENTS

| | | | |
|---|---|---|---|
| CN | 2064363 | U | 10/1990 |
| CN | 101157874 | A | 4/2008 |
| CN | 202226816 | U | 5/2012 |
| DE | 3315738 | A1 | 11/1983 |
| DE | 3329367 | C1 | 11/1984 |
| DE | 10154785 | A1 | 5/2003 |
| DE | 102009031436 | A1 | 1/2011 |
| DE | 102011052785 | B3 | 12/2012 |
| GB | 606340 | A | 8/1948 |
| GB | 611524 | A | 11/1948 |
| GB | 725865 | A | 3/1955 |
| GB | 871094 | A | 6/1961 |
| JP | 50148405 | A | 11/1975 |
| JP | 60004588 | A | 1/1985 |
| JP | 262285980 | | 12/1987 |
| JP | H0319127 | | 3/1991 |
| JP | 07188668 | | 7/1995 |
| JP | 07216357 | | 8/1995 |
| JP | 08127778 | A | 5/1996 |
| JP | 2001200258 | A | 7/2001 |
| JP | 03197588 | B2 | 8/2001 |
| JP | 2002106941 | A | 4/2002 |
| JP | 200341258 | A | 2/2003 |
| JP | 04159392 | B2 | 10/2008 |
| JP | 2009144121 | A | 7/2009 |
| KR | 960008754 | | 10/1996 |
| KR | 1019990054426 | | 7/1999 |
| KR | 200000042375 | A | 7/2000 |
| KR | 10-0797852 | | 1/2008 |
| KR | 10-0296700 | B1 | 10/2011 |
| KR | 101318388 | B1 | 10/2013 |
| WO | WO-9012074 | A1 | 10/1990 |
| WO | WO-9945083 | A1 | 9/1999 |
| WO | WO-2008034424 | A1 | 3/2008 |
| WO | 2011000447 | A1 | 1/2011 |
| WO | WO-2012029979 | A1 | 3/2012 |
| WO | 2013023872 | A1 | 2/2013 |

OTHER PUBLICATIONS

JP 04-159392, Inoue Keizo et al., Method and Equipment for Opening Hole for Degassing of Coal Charge in Coke Oven, Japanese Patent (Abstract Only) Jun. 2, 1992.

International Search Report and Written Opinion of International Application No. PCT/US2010/021094; Date of Mailing: Mar. 1, 2010; 6 pages.

Crelling, et al., "Effects of Weathered Coal on Coking Properties and Coke Quality", Fuel, 1979, vol. 58, Issue 7, pp. 542-546.

Database WPI, Week 199115, Thomson Scientific, Lond, GB; AN 1991-107552.

Diez, et al., "Coal for Metallurgical Coke Production: Predictions of Coke Quality and Future Requirements for Cokemaking", International Journal of Coal Geology, 2002, vol. 50, Issue 1-4, pp. 389-412.

Extended European Search Report in European Application No. 10753829.0; Date of Mailing May 14, 2014, 3 pages.

U.S. Appl. No. 14/655,003, filed Jun. 23, 2015, Ball, Mark A., et al.

U.S. Appl. No. 14/655,013, filed Jun. 23, 2015, West, Gary D., et al.

U.S. Appl. No. 14/655,204, filed Jun. 24, 2015, Quanci, John F., et al.

U.S. Appl. No. 14/839,384, filed Aug. 28, 2015, Quanci, John F., et al.

U.S. Appl. No. 14/839,493, filed Aug. 28, 2015, Quanci, John F., et al.

U.S. Appl. No. 14/839,551, filed Aug. 28, 2015, Quanci, John F., et al.

U.S. Appl. No. 14/839,588, filed Aug. 28, 2015, Quanci, John F., et al.

U.S. Appl. No. 14/865,581, filed Sep. 25, 2015, Sarpen, Jacob P., et al.

ASTM D5341-99(2010)e1, Standard Test Method for Measuring Coke Reactivity Index (CRI) and Coke Strength After Reaction (CSR), ASTM International, West Conshohocken, PA, 2010.

Canada Office Action in Canadian Application No. 2754737, Mailing Date Mar. 21, 2013, 2 pages.

Clean coke process: process development studies by USS Engineers and Consultants, Inc., Wisconsin Tech Search, request date Oct. 5, 2011, 17 pages.

India First Examination Report in Application No. 7983/DELNP/2011, Mailing Date Sep. 7, 2015, 2 pages.

Rose, Harold J., "The Selection of Coals for the Manufacture of Coke," American Institute of Mining and Metallurgical Engineers, Feb. 1926, 8 pages.

U.S. Appl. No. 14/959,450, filed Dec. 4, 2015, Quanci et al.

U.S. Appl. No. 14/983,837, filed Dec. 30, 2015, Quanci et al.

U.S. Appl. No. 14/984,489, filed Dec. 30, 2015, Quanci et al.

U.S. Appl. No. 14/986,281, filed Dec. 31, 2015, Quanci et al.

U.S. Appl. No. 14/987,625, filed Jan. 4, 2016, Quanci et al.

* cited by examiner

FLAT PUSH COKE WET QUENCHING APPARATUS AND PROCESS

This application is a continuation of application Ser. No. 12/405,269, filed Mar. 17, 2009, now U.S. Pat. No. 7,998,316.

FIELD

The disclosure relates to a method and apparatus for producing coke from coal and in particular to an apparatus and method for wet quenching of a flat pushed incandescent slab of metallurgical coke in a single, multipurpose apparatus.

BACKGROUND AND SUMMARY

Metallurgical coke is a solid carbon fuel and carbon source used to melt and reduce iron ore in the production of steel. During an iron-making process, iron ore, coke, heated air and limestone or other fluxes are fed into a blast furnace. The heated air causes combustion of the coke which provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores is produced by batch feeding pulverized coal to an oven which is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused incandescent mass or slab of coke having a predetermined porosity and strength. Because the production of coke is a batch process, multiple coke ovens are operated simultaneously, hereinafter referred to as a "coke oven battery". For the purposes of this disclosure, the term "incandescent coke" means the normal state of coke when it is discharged from a coke oven. Incandescent coke is typically discharged from a coke oven at a temperature ranging from about 980° to about 1320° C.

In a conventional coke oven process, once the coal is "coked out", the coke slab is pushed from the coke oven so that it breaks up and drops into a hot car wherein the coke is quenched with water to cool the coke below its ignition temperature. The quenching operation must be carefully controlled so that the coke does not absorb too much moisture. Once it is quenched, the coke is screened and loaded into rail cars or trucks for shipment.

One of the problems associated with the coke making process is dusting problems associated with removing the hot coke from the oven and dropping the coke into a quenching car as the coke is discharged from the coke ovens. As the coke drops into the quenching car, a significant amount of coke dust is created. Likewise, the quenching step produces steam and particulate matter as the coke is quenched. In fact, the largest single source of particulate matter emissions in a coke making process occurs during the coke discharge and quenching operations. Accordingly, elaborate dust collection systems have been devised to capture dust particles generated as the coke is pushed into the quench cars. However, many of these systems rely on pressure drop through a device, such as baffles or multi-cyclones to obtain efficient particulate removal. However, conventional quench systems have very little available pressure drop available for high efficiency removal of particulate matter. In order to reduce the dusting problems associated with coal coking without significantly increasing coke oven cycle times, improved apparatus and methods for quenching coke are needed.

In accordance with the foregoing need, the disclosure provides a method and apparatus for quenching metallurgical coke made in a coking oven. The method includes pushing a unitary slab of incandescent coke onto a substantially planar receiving surface of an enclosed quenching car so that substantially all of the coke from the coking oven is pushed as a unitary slab onto the receiving surface of the quenching car. The slab of incandescent coke is quenched in an enclosed environment within the quenching car with a plurality of water quench nozzles while submerging at least a portion of the slab of incandescent coke by raising a water level in the quenching car. Subsequent to quenching the coke, the planar receiving surface is tilted to an angle sufficient to slide the quenched coke off of the planar receiving surface and onto a product collection conveyer and sufficient to drain water from the quenched coke.

Another embodiment of the disclosure provides a movable apparatus for reducing dusting during a coke quenching step of a metallurgical coke making process. The apparatus includes a substantially fully enclosable quenching car adapted to receive a unitary slab of incandescent coke. The quenching car has an enclosable structure having a tiltable water quenching table disposed between a coke inlet end having an inlet door and a coke discharge end opposite the inlet end, the discharge end having a coke discharge door. Water spray nozzles are disposed between the inlet end and the discharge end above the quenching table. A water quenching sump is provided below the water quenching table for submerging a portion of the slab of incandescent coke in quench water. A dust collection system is attached to the enclosable structure for collecting water droplets and particulates from the coke quenching step.

The method and apparatus described above provide unique advantages for coking operations. In particular, flat pushing of the coke onto a quench car as a unitary slab of incandescent coke may significantly reduce an amount of particulate matter generated during a coke oven discharge operation. Accordingly, dust collection equipment for collecting particulate matter during the coke discharge operation may be substantially smaller and may provide higher dust collection efficiencies. Another advantage of the method and apparatus disclosed herein may be the simplicity of operation and the elimination of structures and equipment necessary to quench the coke and handle the quenched coke product. For example, the dust collection system has no moving parts and may rely only on pressure generated in a substantially enclosed chamber as a motive force for gas flow through the dust collection system.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF EXEMPLARY EMBODIMENTS

Figure 1:
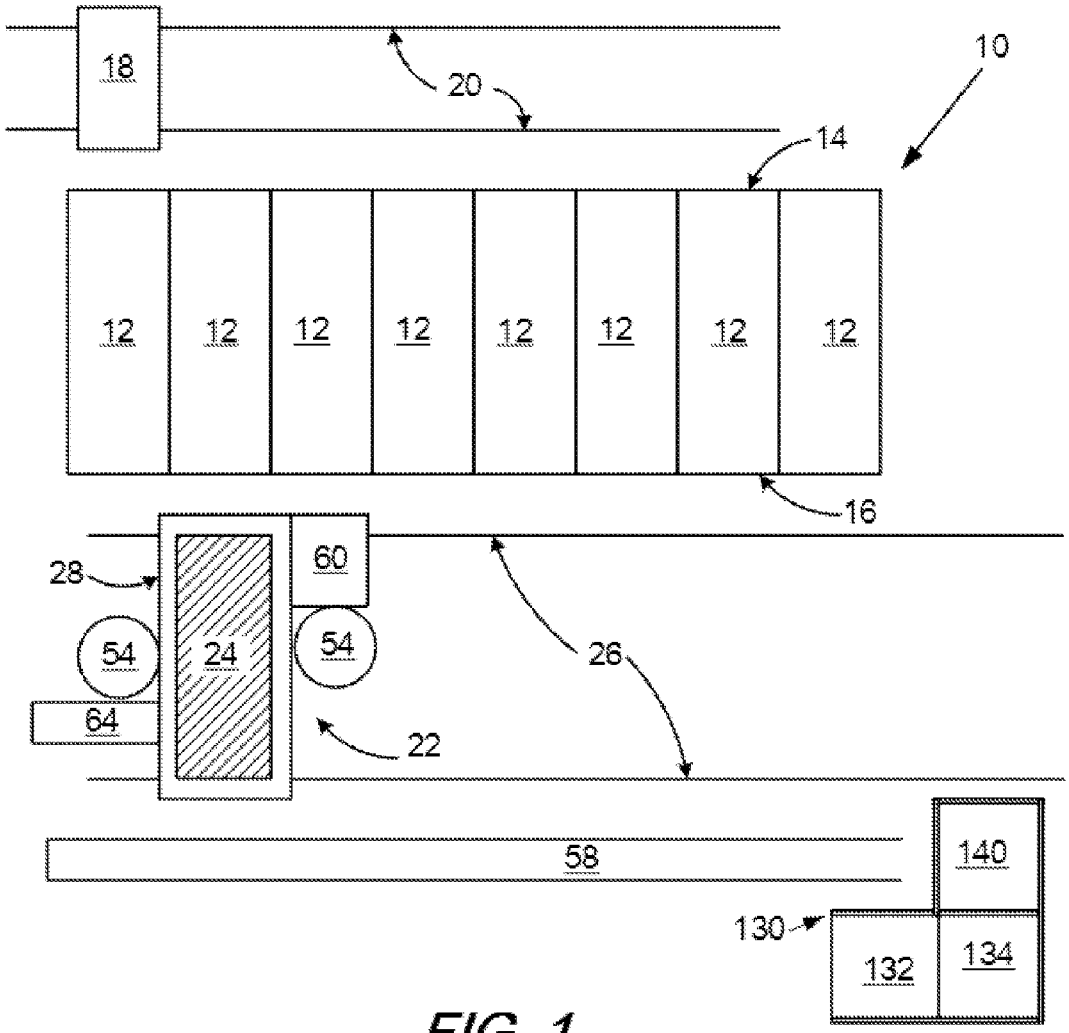
FIG. 1 is an overall plan view, not to scale, of a coke oven battery and associated equipment showing a quenching car in a first position for receiving coke from a coke oven.

For purposes of this disclosure, a "unitary slab of coke" is intended to include fused incandescent coke structures as made in a coking oven. The unitary slabs of coke may have sizes ranging from about a meter wide to tens of meters long and up to about 1.5 meters deep and may weigh between about 20 and about 40 metric tons. With reference to FIG. 1, there is illustrated a plan schematic view of a coke oven battery 10 and associated equipment for charging a coke oven battery and for removing and quenching coke produced in the coke oven battery 10 according to an exemplary embodiment of the disclosure. The typical coke oven battery 10 contains a plurality of side by side coke ovens 12. Each of the coke ovens 12 has a coal inlet end 14 and a coke outlet end 16 opposite the inlet end 14.

A typical coal coking cycle may range from 24 to 48 hours or more depending on the size of the coal charge to the coke ovens 12. At the end of the coking cycle, the coke is pushed out of the oven 12 with a discharge ram 18 positioned adjacent the inlet end 14 of the ovens 12. The discharge ram 18 may include a device for removing an inlet end 14 oven door prior to pushing the coke out of the ovens 12. The discharge ram 18 may move along rails 20 adjacent the inlet end 14 of the ovens 12.

A coke quenching device 22 may be positioned adjacent the outlet end 16 of the ovens 12 to remove exit doors from the ovens 12 and to quench the incandescent coke pushed from the ovens 12. In an alternative embodiment, a separate exit door removing device may be used to remove the exit doors from the outlet end 16 of the ovens 12 prior to pushing the coke into a quenching car.

The coke quenching device 22 may be adapted to collect a unitary slab 24 of incandescent coke pushed from the ovens by the discharge ram 18. The coke quenching device 22 moves along rails 26 adjacent the coke outlet end 16 of the ovens 12. A detailed description of the quenching device 22, including alternative mechanisms for positioning the quenching device adjacent the outlet end 16 of the ovens 12 is described in more detail below. During a coke pushing operation, the coke is pushed out of the ovens 12 as a substantially unitary slab 24 into an essentially enclosed structure 28 of the quenching device 22.

Figure 2:
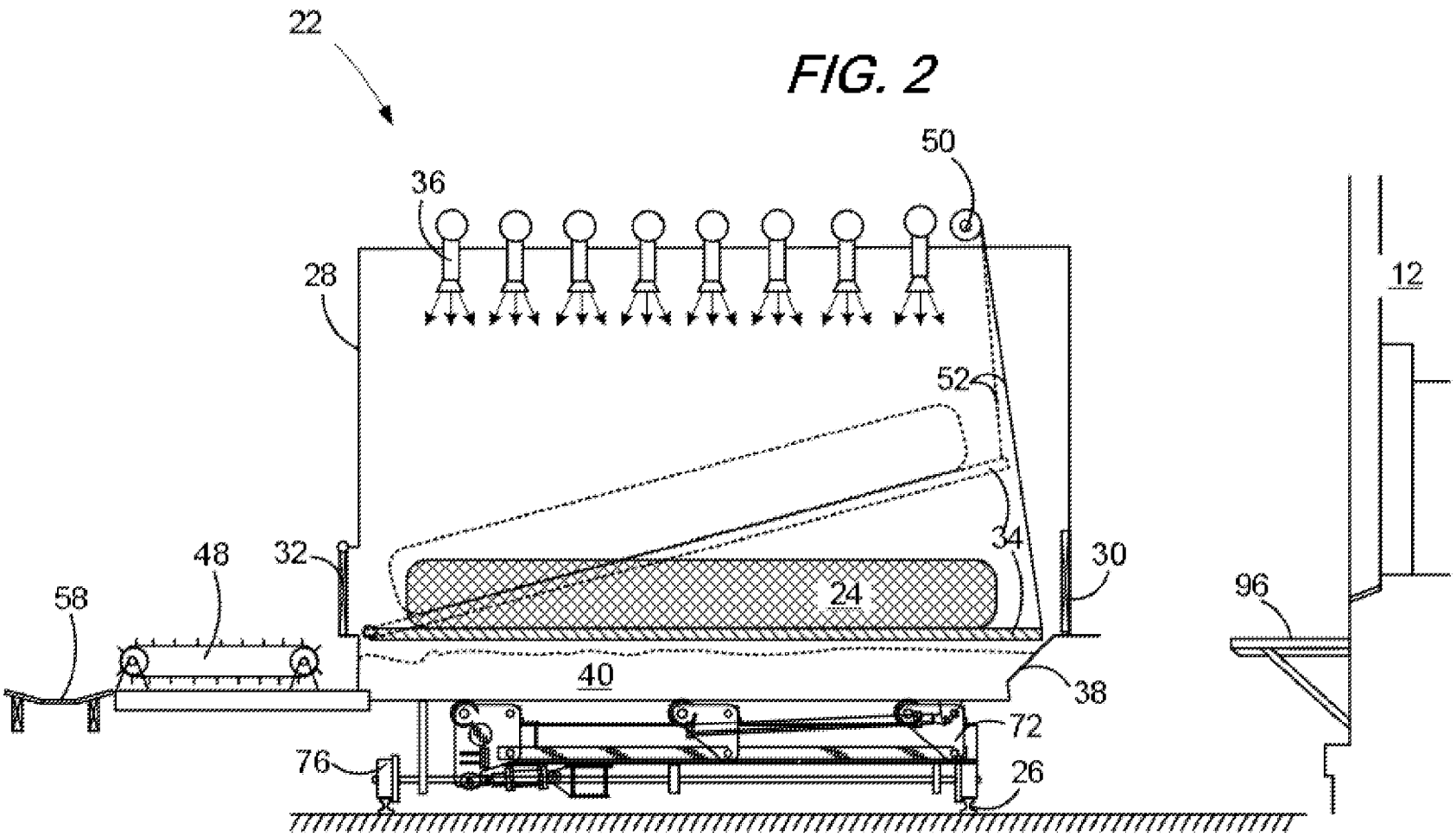
FIG. 2 is a side elevational view, not to scale, a quenching device for receiving and quenching a coke slab from a coke oven.

Once the incandescent coke is loaded onto the quenching device 22, a quenching operation is begun. As shown in FIG. 2, the quenching device 22 includes an essentially enclosed, gas tight structure 28 having an inlet door 30 and an outlet door 32. The inlet door 30 may be a slidable door that provides an opening in the structure 28 that is sufficient to enable the unitary slob of incandescent coke 24 to be pushed onto a tiltable receiving table 34 within the structure 28. As the coke 24 is pushed from the oven 12 into the structure 28, water sprays 36 are activated to initiate a quench of the upper side of the coke 24 and to partially suppress at least a portion of fugitive dust emissions that may be generated as the incandescent coke 24 is pushed onto the tiltable receiving table 34. Once the entire slab of coke 24 is in the structure 28, the inlet door 30 is closed thereby providing a substantially gas tight structure 28.

The structure 28 also includes a sump portion 38 containing a volume of quench water 40. The quench water 40 in the sump portion 38 may provide substantially more quench water than the water spray nozzles 36. In one embodiment, the ratio of the volume of water from the water spray nozzles 36 to the quench water 40 in the sump portion 38 may range from about 1:10 to about 1.1 by volume. Make up water to the spray nozzles 36 and sump portion 38 may be provided by a water channel running along the coke oven battery 10 that supplies a pump aboard the quench device 22.

In order to quench the coke using the quench water 40 in the sump portion 38, a plunger 42 (FIG. 3) may be lowered into the sump portion 38 to raise the quench water 40 from a first level 44 to a second level 46 that at least partially submerges the slab 24 of incandescent coke. The water level is raised by displacing quench water 40 in the sump portion 38 with the plunger 42. The portion of the slab 24 that is submerged in the quench water 40 may vary depending on a thickness T of the slab 24. Typically the portion of the slab that is submerged may range from about 5 to about 50 percent of the thickness T of the slab 24. For example, a slab 24 having a thickness T of about 80 centimeters may be submerged from about 4 to about 40 centimeters by the quench water 40. As the slab 24 is submerged and cooled by direct contact with the quench water 40, upper portions of the slab 24 are quenched by steam generated by the quench water 40 as fissures open up in the coke slab 24 during quenching and by the water sprays 36. The rate of submergence of the slab 24 is relatively slow in order to prevent steam explosions that may be caused by rapid quenching. However, there is a delicate balance between the rate of quenching and a moisture content of the product coke. Accordingly, in order to aid the quenching step and prevent steam explosions, the slab 24 may be split into sections ranging from about three 1 meter wide to about 2 meters wide.

A typical total amount of quenching fluid suitable for quenching the coke slab 24 may range from about 1.5 to about 2.5 parts by weight water per part by weight coke. The quenching step is typically conducted as rapidly as possible and may range from about 1.5 to about 2.5 minutes total to provide coke having a moisture content of less than about 3.0 percent by weight, typically from about 1.5 to about 3.0 percent by weight.

Figure 3:
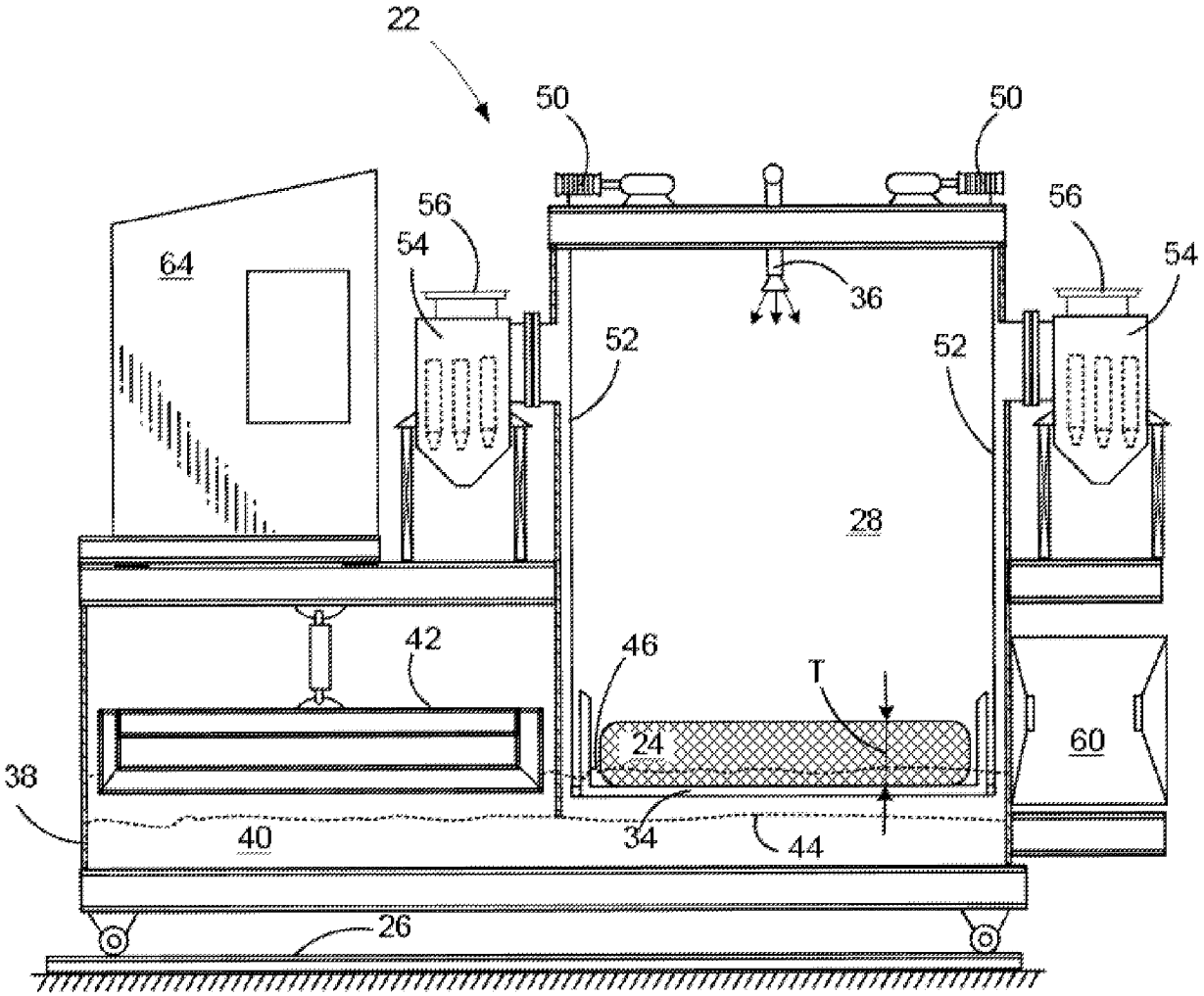
FIG. 3 is an end elevational view, not to scale, a quenching device for receiving and quenching a coke slab from a coke oven.
Figure 4:
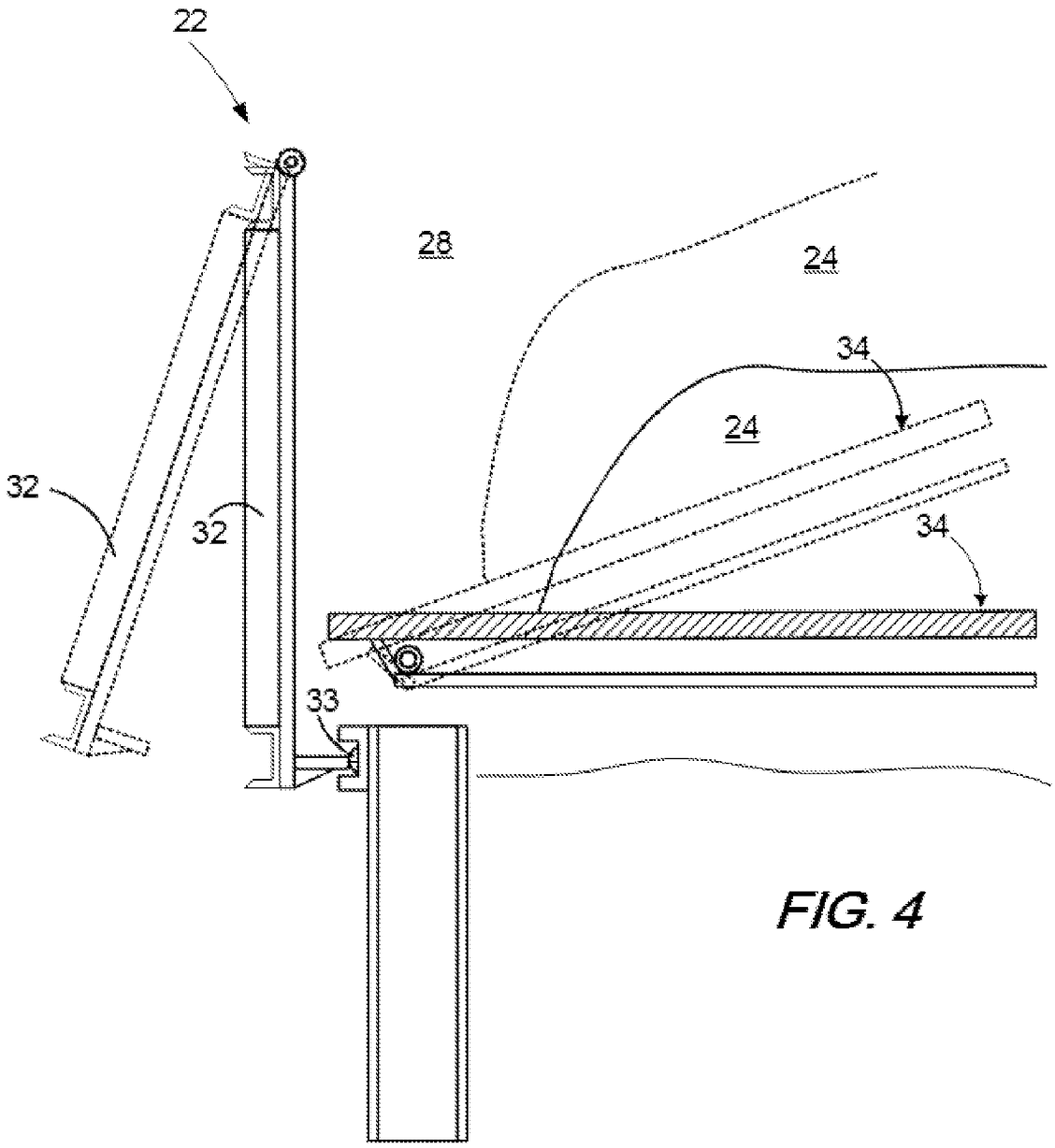
FIG. 4 is a partial elevational view, not to scale, of a quenching device according to the disclosure.

After quenching of the coke slab 24 is complete, the plunger 42 may be raised to lower the water level below the outlet door 32 level of the structure 28. Once the water level is lowered, the outlet door 32 may be opened and a metering conveyer 48 (FIG. 2) may be started to break and convey coke to a product collection area. As shown in FIG. 4, the outlet door 32 may be hingedly attached to the structure 28, wherein in a closed position as shown in FIG. 4, a gasket 33 provides a gas tight seal between the door 32 and the structure 28. The gasket 33 may circumscribe the door opening so that when closed, the door 32 is sealed on all sides with the gasket 33. As the door 32 is opened, as shown in outline in FIG. 4, the tiltable receiving table 34 may be raised by crane hoist 50 and cable 52 assemblies attached to opposing sides of the tiltable receiving table 34 as shown in FIG. 3 or any other suitable mechanism such as a hydraulic lifting device. The tiltable table 34 may be raised to an angle ranging from about 15 to about 40 degrees relative to a substantially horizontal position. As the table 34 is raised, quench water is drained from the quenched slab 24 back into the sump portion 38 and the slab slides onto the metering conveyer 48 which may be a high temperature metering conveyor structure.

The metering conveyor 48 may discharge the coke onto a belt conveyor 58 for transport to a product receiving area. In the event the belt conveyor 58 is not operating, a by-pass chute may be provided to dump the product coke onto the ground adjacent the metering conveyor 48.

When the quenched coke 24 has been completely discharged from the device 22 and drained, the metering conveyor 48 may be stopped, the door 32 may be closed, and the table 34 may be lowered for receiving another slab of incandescent coke 24. During this process, water may be added to the sump portion 38 from the water channel. Also the device may be moved to reposition the device 22 adjacent another oven 12 for receiving another incandescent slab 24 for quenching.

Due to the fact that the structure 28 is substantially gas tight, steam and water vapor generated during the quenching step may pressurize the structure 28 sufficient to cause gas and vapor flow through attached particulate matter collection devices 54 (FIG. 3). The collection devices 54 may be multi-cyclone dust collector devices or any other suitable particular matter collection device that is effective to trap dust and water vapor droplets that may contain coke particulate matter entrained therein. For multi-cyclone dust collectors, the pressure in the structure 28 may range from about 5 to about 25 centimeters of water or more. Since the structure 28 is pressurized by steam and vapor from the quenching step, no forced draft or induced draft fans are required to provide flow through the collection devices 54. In an alternative, an induced draft fan may be used to cause flow through the collection devices 54. Clean gas may be discharged to the atmosphere through exit ducts 56 in the collection devices 56. Accordingly, no moving parts are required to provide suitable collection of dust and particulate matter from the quenching process.

Without desiring to be bound by theoretical considerations, it is believed that the gas tight quench structure 28 describe above may significantly improve the removal efficiency of particulate matter compared to the removal efficiency of conventional induced draft quenching systems. For example, assuming a vapor flow rate ranging from about 416 actual cubic meters per second ($m^3$/sec) to about 250 actual $m^3$/sec in a quenching step, a conventional induced draft quenching system may only provide at most about 0.6 cm of water pressure. Since the available pressure is only about 0.6 cm of water, the pressure drop through any particulate removal device must be less than 0.6 cm of water or about 0.5 cm of water. Accordingly, devices, such as baffles are typically used in an induced draft quench system to create a pressure drop so that particulate matter can be removed from the gas and vapor streams. Accordingly, the pressure generated in a conventional quench system is insufficient for use with high efficiency particulate removal devices such as bag dust collectors and multi-cyclone devices.

By comparison, the same flow rates of gas and vapor in the quenching device 22 described herein may provide a pressure ranging from about 11 cm of water at 416 actual $m^3$/sec to about 4.3 cm of water pressure at 250 actual $m^3$/sec. In view of the higher pressure drop provided by the quenching device 22, a multi-cyclone or other higher pressure drop particulate removal systems may be used. Accordingly, removal efficiency of particulate matter from the gas and vapor streams generated during quenching may be significantly greater than with conventional quenching systems.

Another component of the quenching device 22 may be an integral coke exit door removal device 60. The exit door removing device 60 includes mechanisms to correctly position the device 60 at the outlet end 16 of the oven 12 to be discharged of finished coke, and to remove a coke discharge door 62 (FIG. 5) from the coke outlet end 16 of the oven 12. The door removal device 60 may include a mechanism to rotate rotary wedge locks 63 to unlatch the door 62 and to move the door 62 straight back from the oven 12. The quenching device 22 then moves along the rails 26 to position the inlet door 30 in front of the oven 12 from which the coke discharge door 62 was removed.

The exit door removal device 60 may be manually operated and thus may be controlled from a control booth 64 (FIG. 3) on the quenching device 22. The control booth 64 may include all control devices and motor control center cabinets, as well as an emergency stop button for the quenching device 22. Typically, all operations performed by the door removal device 60 may be hydraulically powered. For example, hydraulic cylinders may be used to unlock rotary locks on the door 62 and to engage and retract the door 62 from oven 12.

Prior to removing the door 62, a laser targeting device may be used by the operator to accurately position the quenching device 22 so that the door removal device 60 is adjacent the coke outlet end 16 of the oven 12. Mechanical interlocks may also be used to assure that the door removal device 60 is in the correct position to unlock and remove the door 62 from the oven 12. A diesel engine may be used to move the quenching device 22 along the rails 26.

Figure 9:
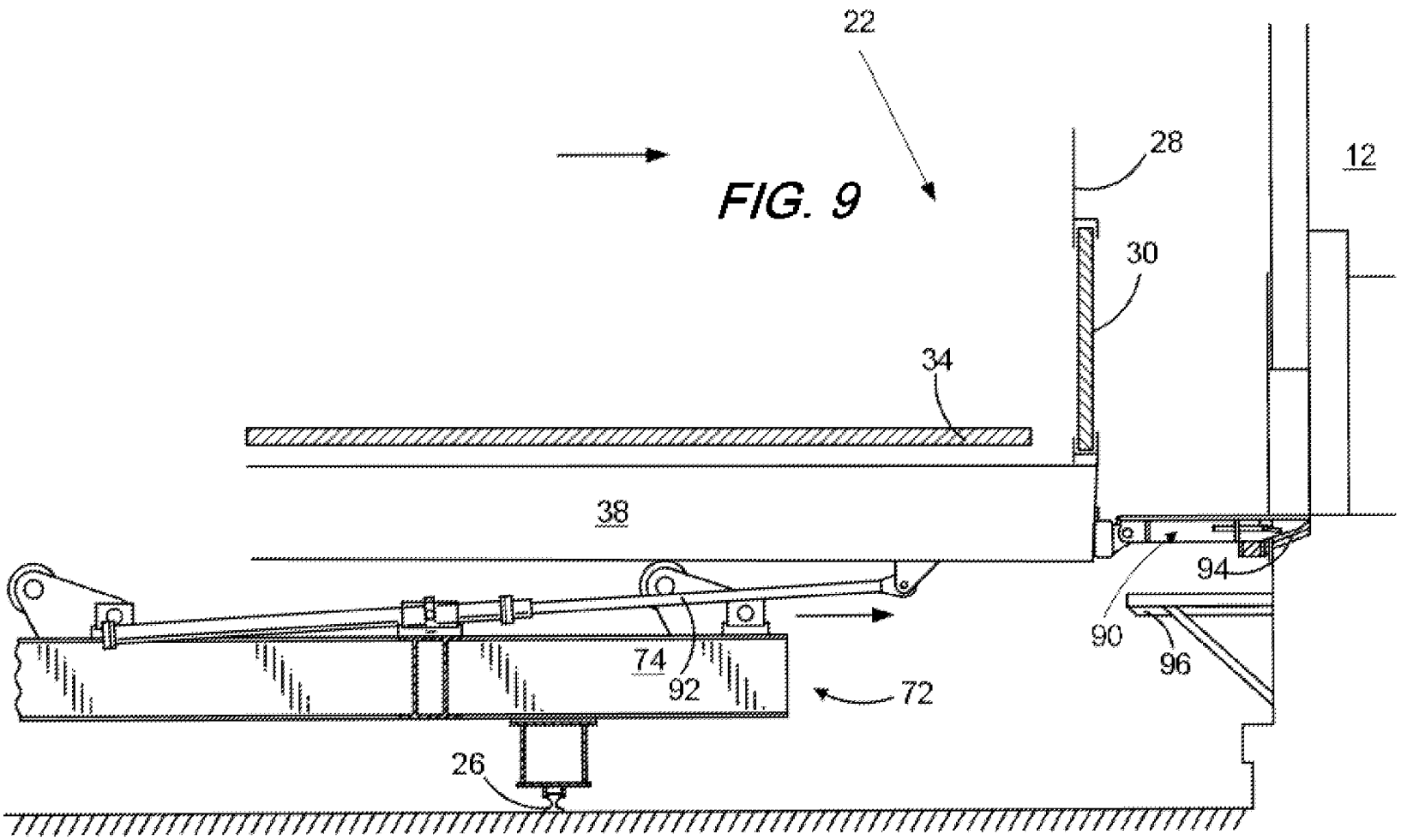
FIG. 9 is partial elevational side view, not to scale, of a quenching device in a raised position and translated position according to an embodiment of the disclosure.
Figure 10:
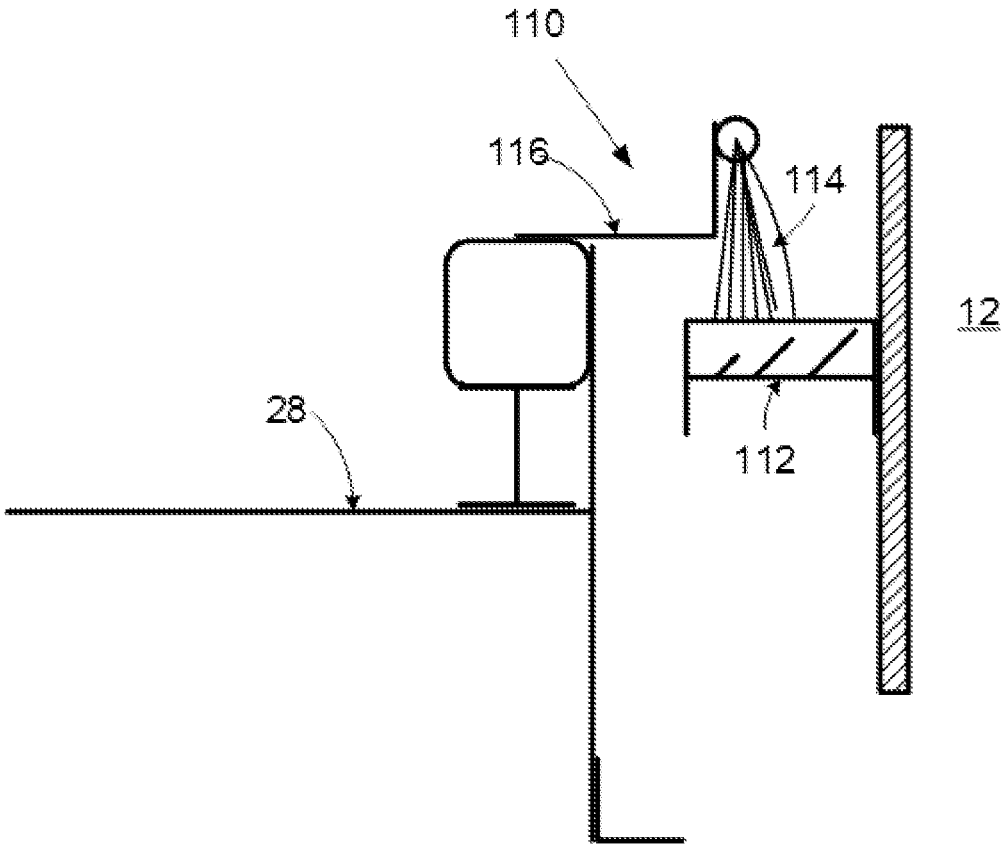
FIG. 10 is an elevation side view, not to scale, of a lintel sealing device attached to an enclosed chamber of a quenching device according to the disclosure.
Figure 11:
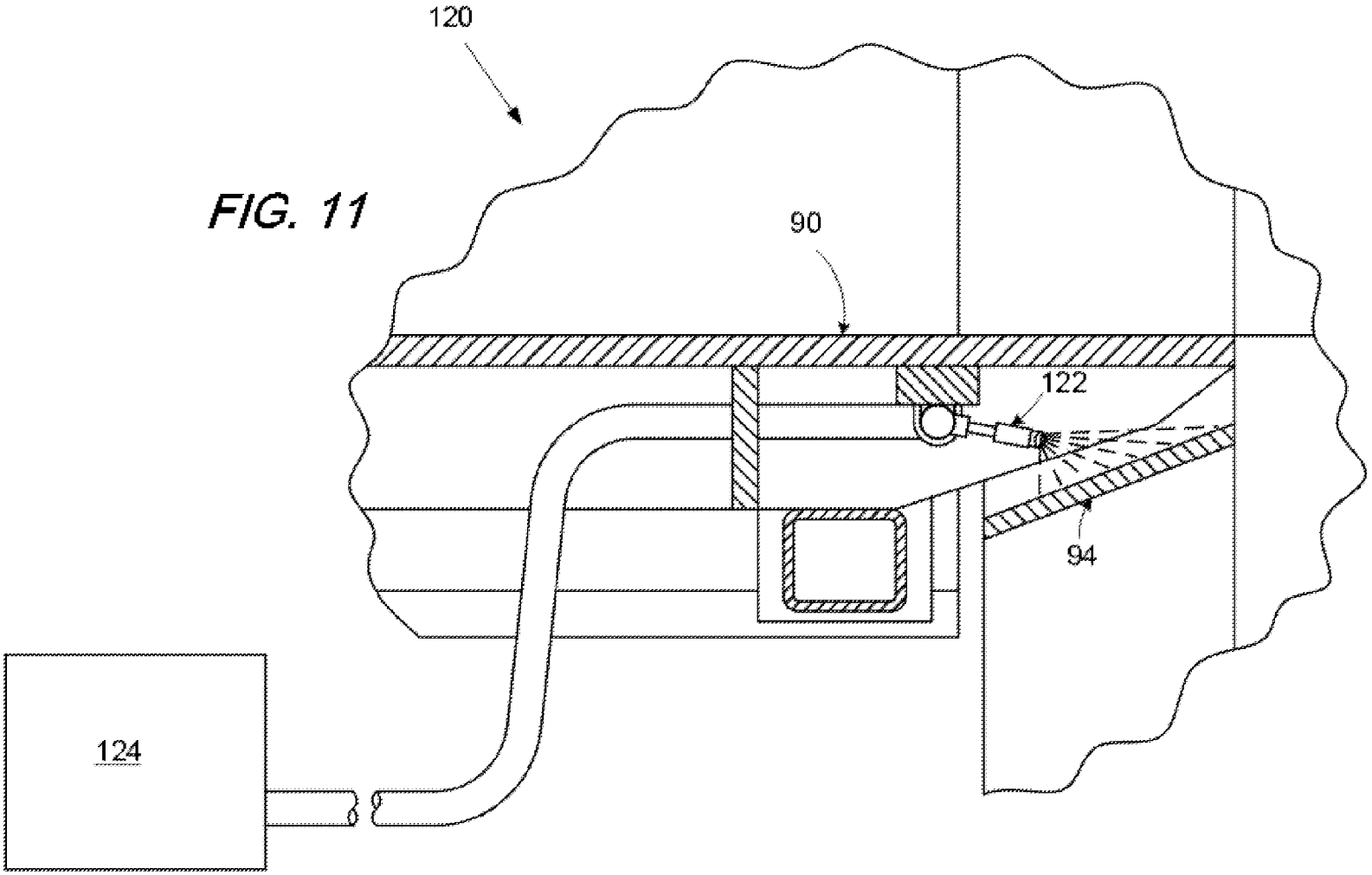
FIG. 11 is a schematic view of an oven sill sweeping device attached to a quenching device according to the disclosure.

With reference now to FIGS. 6-11 various detailed aspects of the quenching device 22 may be illustrated and described. The quenching device 22 is a unique device that enables collection and quenching of a substantially unitary slab 24 of incandescent coke from the coke ovens 12 without the need to further transport or transfer the coke to a separate quenching car in a separate quenching area. The quenching device 22 is designed to traverse parallel to the coke oven battery 10 along the rails 26 adjacent to the ovens 12. In an alternative embodiment, the quenching device 22 may also contain an elevation and translation mechanism 72 (FIGS. 6-9), a lintel sealing device 110 (FIG. 10), and an oven skirt sweeping mechanism 120 (FIG. 11). Each of these mechanisms will be described in more detail below.

After the door removal device 60 has removed the coke exit door 62 from an oven 12, the quenching device 22 may be re-positioned in line with the oven 12 to receive the coke being pushed out of the oven 12 as shown in FIG. 1. A laser spotting device may be provided to assist an operator in visually aligning the quenching device 22 for proper interface with the oven 12. Once the quenching device 22 has been properly spotted, one or more mechanical interlocks are activated to assure that the quenching device 22 is in the proper position for receiving the coke slab 24.

Figure 5:
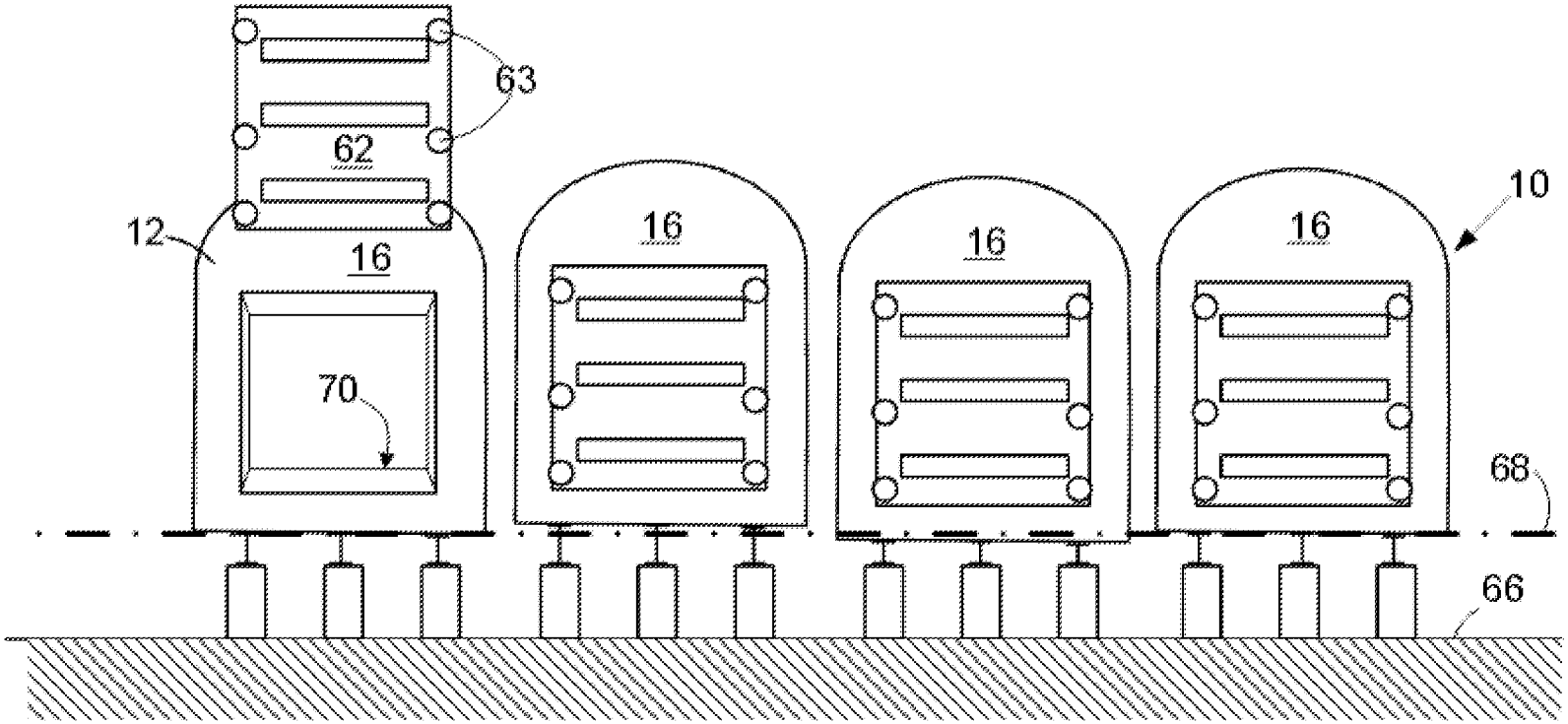
FIG. 5 is a coke discharge end view, not to scale, of a portion of a coke oven battery.

With reference now to FIG. 5, a portion of the coke oven battery 10 viewed from the coke outlet end 16 of the ovens 12 is illustrated. As will be appreciated, each of the ovens 12 may be at slightly different heights above a ground elevation 66 as indicated by reference line 68. Accordingly, the quenching device 22 must be adjusted to the height of each oven 12 during the coke pushing operation in order to push a substantially unitary slab 24 of hot coke onto the tiltable receiving table 34 of the quenching device 22 without substantially fracturing the slab 24. In other words, the slab 24 of coke is not dropped into the quenching device 22 as in conventional quench cars where the coke is dropped so that the slab breaks up into smaller chunks of coke for quenching. Accordingly, a mechanism is provided on the quenching device 22 to position the enclosed structure 28 adjacent the outlet end 16 of the oven 12 and for providing a relatively smooth transition for the slab 24 of coke to move from an oven floor 70 into the enclosed structure 28.

With reference again to FIGS. 2-3, a side elevational view of the quenching device 22 and an end elevational view of the quenching device 22 are illustrated. The quenching device 22 includes the enclosed structure 28 that is movably disposed on the elevation and translation mechanism 72 (FIGS. 6-9) described in more detail below. As shown in FIG. 2, the enclosed structure 28 is mounted on a frame 74 that contains wheels 76 for movement of the quenching device on the rails 26.

Figure 6:
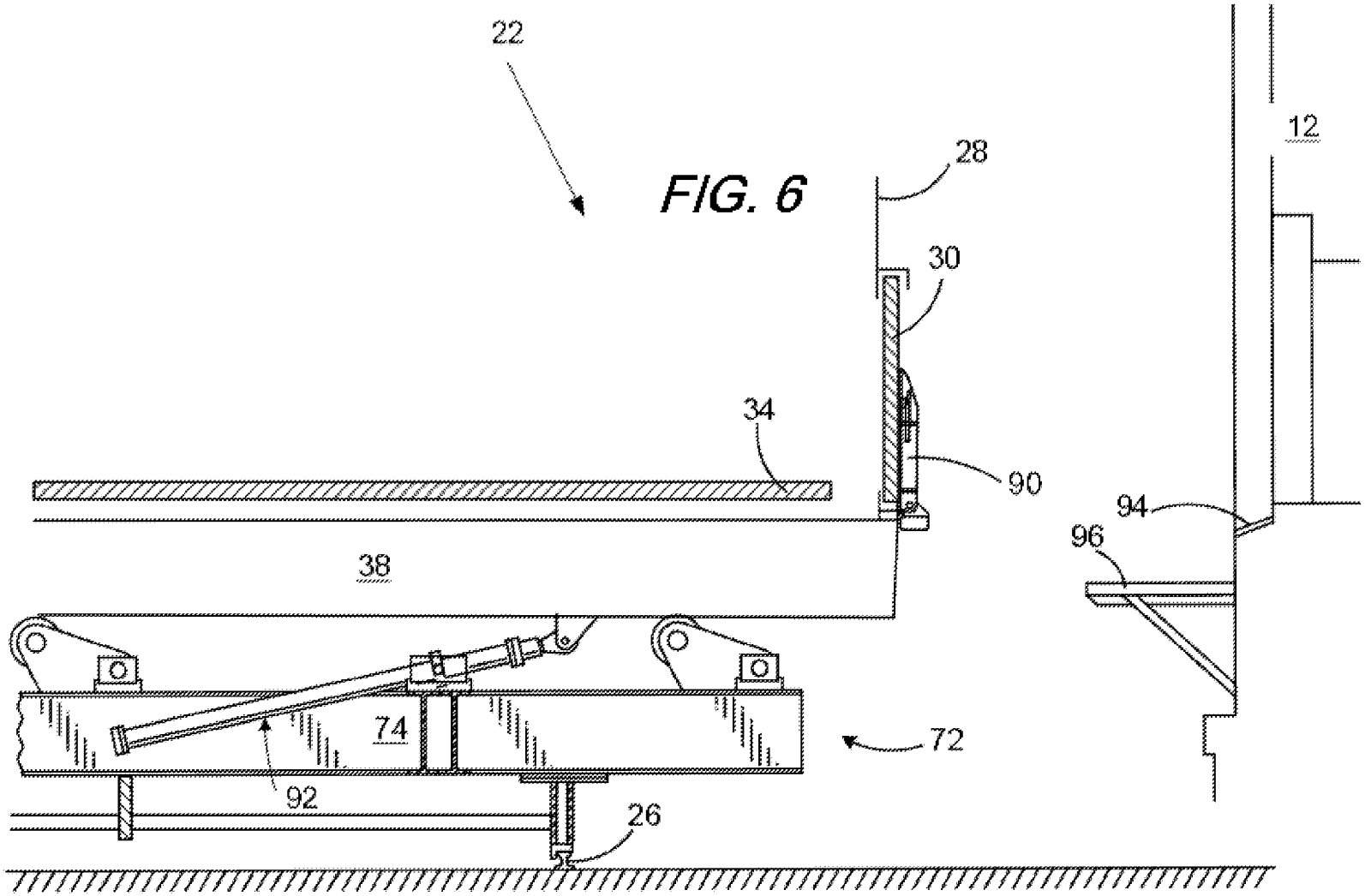
FIG. 6 is partial elevational side view, not to scale, of a quenching device in a raised position according to an embodiment of the disclosure.

FIG. 2 illustrates a first elevational position of the enclosed structure 28 relative to the frame 74. The first elevational position is used for moving the quenching device 22 along the rails 26. In the first elevational position, the enclosed structure 28 is closely adjacent the frame 74. Upon positioning the quenching device 22, adjacent the oven 12, the enclosed structure 28 is raised to a second elevational position as shown in FIG. 6. In the second elevational position, the tiltable receiving table 34 of the quenching device 22 is substantially at the same height as the oven floor 70 (FIG. 5).

Figure 7:
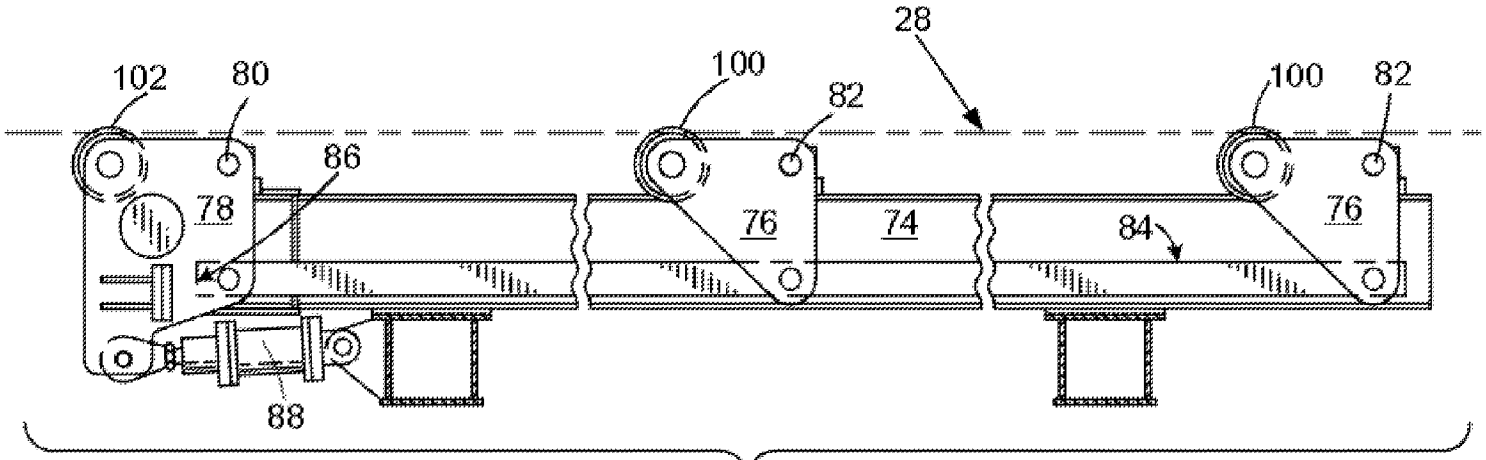
FIG. 7 is an elevational side view, not to scale, of details of an elevation and translation mechanism in a first position according to the disclosure.
Figure 8:
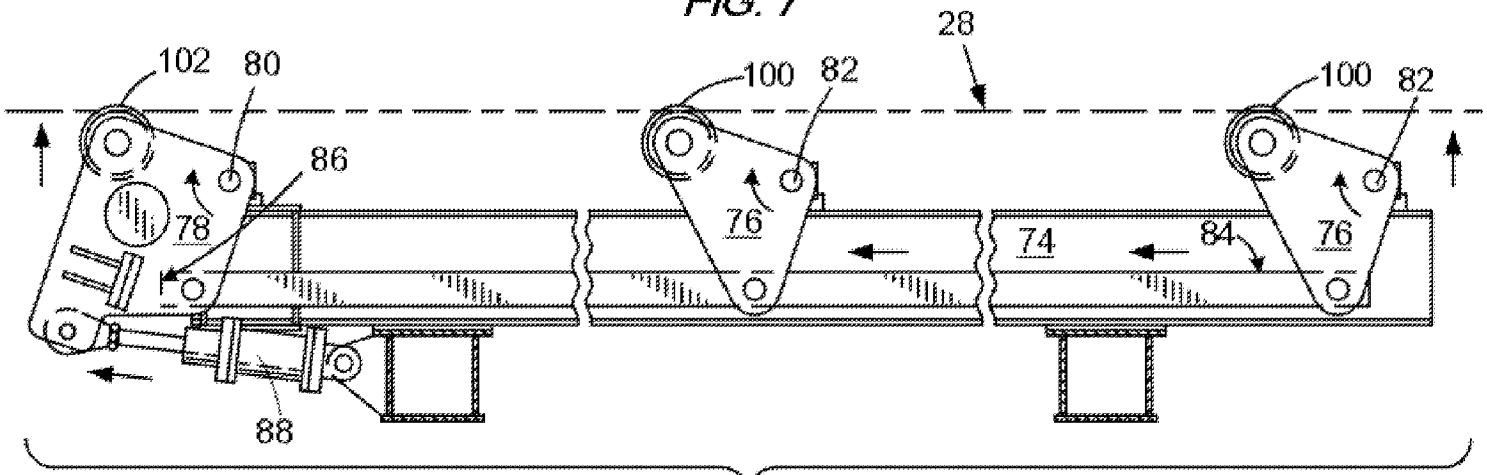
FIG. 8 is an elevational side view, not to scale, of details of the elevation and translation mechanism of FIG. 7 in a second position according to the disclosure.

A portion of the elevational and translation mechanism 72 is illustrated in more detail in FIGS. 7-8. As shown in FIGS. 7 and 8, the mechanism 72 has pivoting rollers 76 an actuator roller 78. Each pivoting roller 76 and actuator roller 78 is attached to the frame 74. The actuator roller 78 is attached to the frame 74 about a pivot pin 80 and the pivoting rollers 76 are attached to the frame 74 about a pivot pin 82. Each of the rollers 76 and 78 is pivotally linked to an actuator arm 84 for rotating the pivoting rollers 76 and actuator roller 78 from the first position illustrated in FIG. 7 to the second position illustrated in FIG. 8. The actuator arm 84 is pivotally connected on a distal end 86 to the actuator roller 78 so that movement of the actuator roller 78 causes movement of the pivoting rollers 76 as shown. An actuator mechanism 88 is attached to the frame 74 and to the actuator roller 78 to cause movement of the actuator roller 78 and the pivoting rollers 76 in order to raise and lower the enclosed chamber 28. The actuator mechanism 88 may be selected from a wide variety of mechanisms such as worm gears, chain drives, hydraulic cylinders, and the like. A hydraulic cylinder actuator mechanism 88 is particularly suitable for use in the elevation and translation mechanism 72 described herein.

As set forth above, due to oven height disparities between ovens 12, the alternative elevation and translation mechanism 72 may be used to provide the enclosed chamber 28 at a desired elevation for pushing the substantially unitary slab 24 of coke onto the quenching device 22. Variations in oven height typically range from about 2.5 to about 15 cm. Accordingly, the elevation and translation mechanism 72 should be capable of moving the enclosed chamber 28 up or down from 2.5 to about 15 cm and holding the enclosed chamber 28 at a desired elevation between 2.5 and 15 cm. It will be appreciated that height elevations that may be needed for a particular oven battery may range more than from about 2.5 to about 15 cm.

Once enclosed structure 28 is at an elevation, illustrated in FIG. 6, that is suitable for transfer of the substantially unitary slab 24 of coke from the oven 12, the operator traverses the enclosed structure forward so that the inlet door 30 of the enclosed structure 28 is closely adjacent to the oven 12, as shown in FIG. 7, to provide a substantially continuous surface for pushing the coke from the oven into the enclosed structure 28. A transition section 90 may be pivotally attached adjacent the inlet door 30 end of the enclosed structure 28 to prevent the enclosed structure 28 from damaging the oven floor 70 upon mating the enclosed structure 28 with the oven 12.

Referring again to FIG. 6, once the enclosed structure 28 is at the desired elevation, a translation actuator 92 attached to the frame 74 and to the enclosed structure 28 may be used to translate the enclosed structure from a retracted position, shown in FIG. 6, to a coke pushing position, shown in FIG. 9. In the retracted position, there is a space between the oven 12 and enclosed structure 28 sufficient for movement of the quenching device 22 along the rails 26 adjacent the ovens 12. However, in the coke pushing position illustrated in FIG. 9, the enclosed structure 28 is closely adjacent to the oven 12 and the transition section 90 is resting on an oven sill 94. After loading the coke into the enclosed chamber 28, enclosed chamber 28 is retracted from the oven 12 and lowered to the first elevational position for quenching the coke and for moving the quenching device 22 to a position to reinstall the exit door 62 on the oven 12.

As shown in FIGS. 6-9, each of the pivoting rollers 76 and the actuator roller 78 contains wheels 100 and 102, respectively that enable a translational movement of the enclosed chamber 28 thereon relative to the frame 74. The wheels 100 and 102 engage a bottom portion of the enclosed chamber 28 or rails attached to the bottom portion of the enclosed chamber 28 for rolling movement thereon.

In another alternative embodiment, the quenching system 22 may be positioned on rails 26 closely adjacent to the ovens 10 so that a portion of the quenching system 22 overhangs a coke side bench 96. In such embodiment, the transition section 90 may be used to provide a smooth transfer of the coke slab 24 into the quenching device 22. Hence, the above described the elevation and translation mechanism 72 may not be required for this embodiment.

In order to reduce emissions of gases and particulates during the transfer of the coke slab 24 from the oven 12 to the quenching device 22, the lintel sealing device 110 is provided as shown in more detail in FIG. 10. The lintel sealing device 110 and engages a lintel beam 112 of the oven 12 when enclosed structure 28 is closely adjacent to the oven 12. The lintel sealing device 110 provides sealing between the enclosed structure 28 the oven 12 in order to reduce an amount of dust, fumes, and particulate matter that may escape from the open end 16 of the oven 12. The lintel sealing device 110 includes a flexible wire brush-like member 114 fixedly attached to an extension arm 116 on the enclosed structure 28 for sealing contact with a lintel beam 112 of the oven 12 as the enclosed structure 28 is traversed toward the oven 12.

During the coke pushing step for pushing the coke slab 24 into the enclosed chamber, 28, coke dust may accumulate on the oven sill 94 attached to each oven 12 after removing the oven exit door 62. Accordingly, the oven skirt sweeping mechanism 120, as shown in FIG. 11 may be provided on the transition section 90 to remove coke dust from the sill 94 in order to provide a smooth transition between the oven floor 70 and the transition section 90. In one embodiment, the sweeping mechanism 120 may include a gas jet spray nozzle 122 and a source 124 of compressed gas in fluid flow communication with the spray nozzle 122. The spray nozzle 122 may be activated by the operator when the oven door 62 is removed to provide a relatively coke free sill 94 for mating with the transition section 90 of the quenching device 22 and/or after pushing the coke into the quenching device 22 before replacing the oven exit door 62.

Once the coke slab 24 has been pushed into the enclosed structure 28 by the coke discharge ram 18, the operator retracts enclosed structure 28 away from the oven 12 and lowers the structure 28 to the first elevational position illustrated in FIG. 2.

Figure 12:
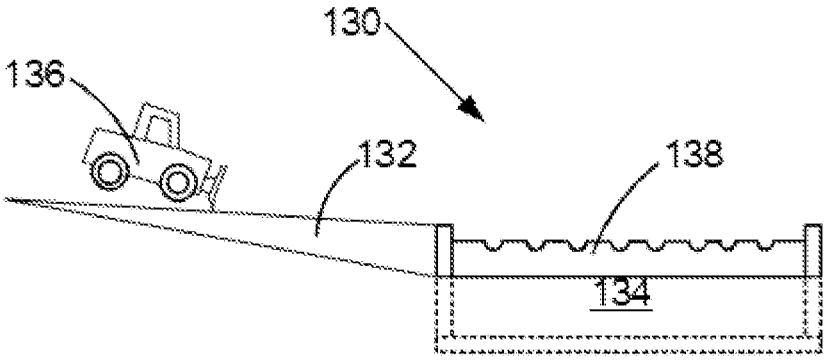
FIG. 12 is a schematic elevational view, not to scale, of a solids separation apron and sump according to the disclosure.
Figure 13:
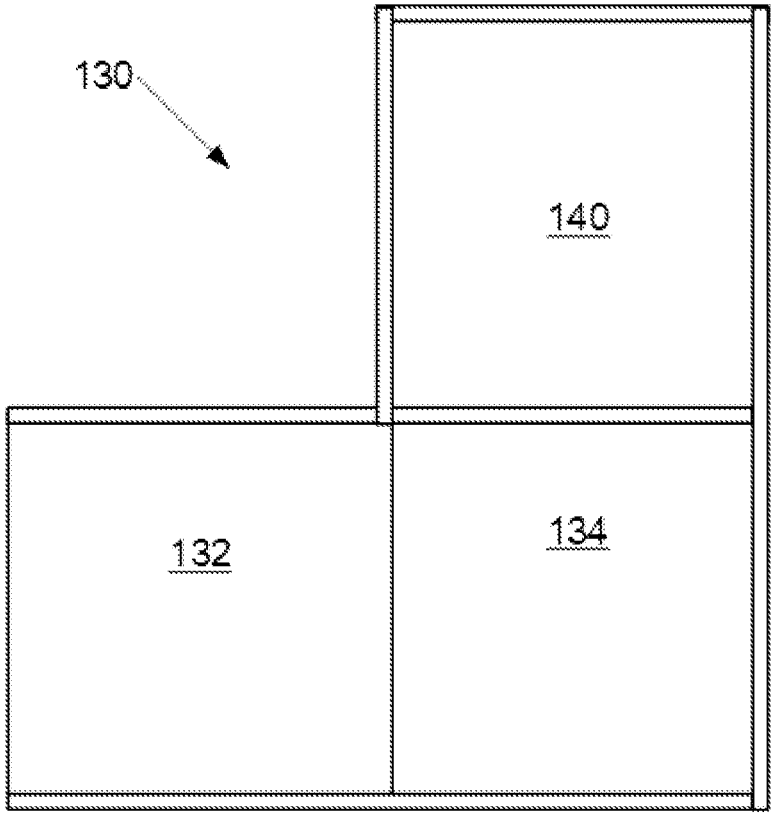
FIG. 13 is a plan view, not to scale, of the solids separation apron and sump of FIG. 12.

As with any coke quenching operation, solids, including coke fines plus ash from the coke slab 24 may accumulate in the quench water 40 in the sump portion 38 of the quenching device 22. It is anticipated that the sump portion 38 may be able to hold the solids from about 50 oven pushes (about 8 hours of quenching operation). After 50 pushes, the quenching device 22 may be trammed to a solids dewatering area 130 illustrated in FIGS. 12 and 13.

Once the quenching device 22 is in the solids dewatering area 130, which may be located at one end of the coke oven battery 10 as shown in FIG. 1, drain valves of a size sufficient to pass water and the solids through may be opened up in the sump portion 38 of the quenching device 22. It is highly desirable that the sump portion 38 of the quenching device be sloped to aid in the removal of solids with the water from the sump portion. "Water cannon" type nozzles may be included in the sump portion 38 to flush solids out of the sump portion 38 during draining. After the sump portion 38 has been drained and cleaned, discharge valves are closed and the sump portion 38 may be refilled with clean water.

The discharge water with solids is directed to a gently sloping concrete apron 132. The slope of the gently sloping apron 132 may range from about one percent to about five percent slope. As the water and solids flow down the gently sloping apron 132, most of the solids may be left on the apron 132 and the water flows into a holding basin 134. The holding basin may be of a size suitable to hold from about 60,000 to about 100,000 gallons or more. The solids on the apron 132 may be removed periodically using a front end loader 136.

Water from the holding basin 134 may overflow through a weir 138 into a clear well 140. The clear well 140 may be used to provide make up water to the sump portion 38 of the quenching device 22. The clear well may be sized to hold from about 120,000 to about 200,000 gallons of water, or may be sized to hold the same amount of water as the holding basin.

In the foregoing description, the entire apparatus with the exception of conveyor belts, electrical components and the like may be made of cast or forged steel. Accordingly, robust construction of the apparatus is possible and provides a relatively long lasting apparatus which is suitable for the coke oven environment.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method for quenching metallurgical coke made in a coking oven, the method comprising the steps of:

pushing fused incandescent coke structures onto a substantially horizontal planar receiving surface of an enclosed quenching car so that substantially all of the coke from the coking oven is pushed as a unitary slab onto the receiving surface of the quenching car;

quenching the slab of incandescent coke in a substantially enclosed, gas tight environment with quench water from a plurality of water quench nozzles wherein a portion of the fused incandescent coke structures are partially submerged during a portion of the quenching;

subsequent to the quenching step, tilting the horizontal planar receiving surface about a tilt axis that extends transversely to the length of the planar receiving surface, adjacent one end portion of the planar receiving surface, to an angle less than 90 degrees sufficient to slide the quenched coke off of the end portion of the planar receiving surface and onto a product collection conveyer.

2. The method of claim 1, wherein the enclosed quenching car comprises one or more dust collection devices for removing water droplets and particulate matter from a gas stream generated during the quenching step.

3. The method of claim 1, further comprising removing water droplets and particulate matter from a gas stream generated during the quenching step using one or more dust collection devices having a particulate removal efficiency of greater than about 75 percent.

4. The method of claim 1, wherein the coke is quenched adjacent to the coking oven.

5. The method of claim 1, wherein the quenching step is sufficient to fracture substantially the entire unitary slab of coke.

6. The method of claim 1, further comprising removing and replacing a coking oven door using an oven door removing and replacing mechanism attached to the quenching car.

7. The method of claim 1, wherein the angle the planar receiving surface is tilted for sliding the quenched coke off of the planar receiving surface ranges from about 10 degrees to about 40 degrees relative to a substantially horizontal plane.

8. The method of claim 1, further comprising generating a pressure ranging from about 5 to about 25 cm of water in the enclosed, gas tight environment of the quenching car during the quenching step.

9. The method of claim 1, wherein during the pushing step and the quenching step the unitary slab of incandescent coke remains in a substantially horizontal position relative to the receiving surface of the quenching car.

10. The method of claim 1, further comprising removing solid material from the quench water to provide a volume of recycled, clean quench water.

11. The method of claim 1, further comprising quenching a slab of incandescent coke with a volume of recycled, clean quench water.

12. A movable apparatus for reducing dusting during a coke quenching step of a metallurgical coke making process, comprising:

a substantially fully enclosable quenching car adapted to receive a unitary slab of incandescent coke, the quenching car comprising:

an enclosable, gas tight structure having a coke inlet end having an inlet door, a coke discharge end opposite the inlet end having a coke discharge door, and a tiltable water quenching table disposed between the coke inlet end and the coke discharge end of the gas tight structure; the tiltable water quenching table having opposite end portions that extend transverse to a length of the tiltable water quenching table; the tiltable water quenching table being selectively pivotable about a tilt axis that extends transversely to the length of the tiltable water quenching table, adjacent one end portion of the tiltable water quenching table;

water spray nozzles disposed between the inlet end and the discharge end above the quenching table; and a dust collection system attached to the enclosable structure for collecting water droplets and particulates from the coke quenching step.

13. The apparatus of claim 12, further comprising an oven door removal apparatus attached to the movable apparatus.

14. The apparatus of claim 12, wherein the tiltable water quenching table is tiltable from about 10 degrees to about 40 degrees relative to a substantially horizontal plane.

15. The apparatus of claim 12, further comprising a metering conveyor for delivering quenched coke to a belt conveyor for moving the coke to a product receiving area.

16. The apparatus of claim 12, wherein the dust collection system comprises one or more multi-cyclone dust collectors.

17. A system for producing metallurgical coke from coking ovens, comprising:

a movable apparatus for reducing dusting during a coke quenching step of a metallurgical coke making process, comprising:

a substantially fully enclosable quenching car adapted to receive a unitary slab of incandescent coke, the quenching car comprising:

an enclosable, gas tight structure having a coke inlet end having an inlet door, a coke discharge end opposite the inlet end having a coke discharge door, and a tiltable water quenching table disposed between the coke inlet and the coke discharge end of the gas tight structure, wherein the tiltable water quenching table is tiltable from about 10 degrees to about 40 degrees, relative to a substantially horizontal plane, about a tilt axis that extends transversely to a length of the tiltable water quenching table, adjacent an end portion of the tiltable water quenching table and the coke discharge end of the gas tight structure;

water spray nozzles disposed between the inlet end and the discharge end above the quenching table;

a metering conveyor for delivering quenched coke to a belt conveyor for moving the coke to a product receiving area; and a dust collection system attached to the enclosable structure for collecting water droplets and particulates from the coke quenching step.

18. The system of claim 17, further comprising an oven door removal apparatus attached to the movable apparatus.

19. The system of claim 17, wherein the dust collection system comprises one or more multi-cyclone dust collectors.

20. The system of claim 17, further comprising a sump water collection area comprising a sloped pad for collecting solids from quench water; a holding basin for quench water flowing from the pad; a clean well adjacent to the holding basin; and a weir disposed between the holding basin and the clean well for overflow of water from the holding basin to the clean well.

* * * * *